United States Patent [19]

Toyoaki et al.

[11] Patent Number: 4,519,839

[45] Date of Patent: May 28, 1985

[54] SINTERED HIGH VANADIUM HIGH SPEED STEEL AND METHOD OF MAKING SAME

[75] Inventors: Ishibachi Toyoaki; Yoshihara Minoru; Takuma Takashi; Fuke Yasunori; Maeda Masayuki, all of Tokyo, Japan

[73] Assignees: The Furukawa Electric Co., Ltd.; Kanto Denka Kogyo Co., Ltd.; Fujidie Co., Ltd., all of Tokyo, Japan

[21] Appl. No.: 657,455

[22] PCT Filed: Apr. 8, 1982

[86] PCT No.: PCT/JP82/00113

§ 371 Date: Dec. 8, 1982

§ 102(e) Date: Dec. 8, 1982

[87] PCT Pub. No.: WO82/03412

PCT Pub. Date: Oct. 14, 1982

Related U.S. Application Data

[63] Continuation of Ser. No. 448,855, Dec. 8, 1982, abandoned.

[30] Foreign Application Priority Data

Apr. 8, 1981 [JP] Japan ..... 56-52709

[51] Int. Cl.³ ..... C22C 33/02; C22C 38/24; C22C 38/36; B22F 1/00

[52] U.S. Cl. ..... 75/242; 75/246; 419/15; 419/29; 419/30; 419/31; 419/32; 419/33; 419/37; 419/45; 419/55; 419/60

[58] Field of Search ..... 419/15, 29, 30, 31, 419/33, 45, 38, 55, 60, 37, 32; 75/242, 246

[56] References Cited

U.S. PATENT DOCUMENTS

| | | | |
|---|---|---|---|
| 3,013,875 | 12/1961 | Triffleman | 419/15 X |
| 3,369,892 | 2/1968 | Ellis et al. | 419/15 X |
| 3,591,349 | 7/1971 | Benjamin | 419/15 X |
| 3,744,993 | 7/1973 | Matt | 419/31 |
| 3,953,194 | 4/1976 | Hartline et al. | 419/15 X |
| 4,063,940 | 12/1977 | Dain et al. | 419/30 |
| 4,242,130 | 12/1980 | Brandis et al. | 75/126 C |

FOREIGN PATENT DOCUMENTS 55-41952 3/1980 Japan .

*Primary Examiner*—Ben R. Padgett
*Assistant Examiner*—Matthew A. Thexton
*Attorney, Agent, or Firm*—Armstrong, Nikaido, Marmelstein & Kubovcik

[57] ABSTRACT

A sintered high vanadium high speed steel with an excellent hardness and ductility of composition C 1.4–6.2%, W+2 Mo (W-equivalent) 10.0–24.0%, Cr 3.0–6.0%, V 8.5–28%, Co less than 17%, the remainder Fe and inevitable impurities, and a method of producing same.

It can be produced by the steps of commingling the alloy constituents in the form of pulverulent oxides and carbon powder, heating the mixture in a stream of hydrogen, thereby reducing the mixture by the carbon and hydrogen simultaneously to yield an alloy powder, adjusting the composition and the grain size of the obtained alloy powder, pressing the alloy powder to a compact, sintered the compact in a vacuum, and finally converting the matrix of the sintered body into martensite by heat treatment.

3 Claims, 3 Drawing Figures

SINTERED HIGH VANADIUM HIGH SPEED STEEL AND METHOD OF MAKING SAME

This application is a continuation of application Ser. No. 448,855, filed Dec. 8, 1982, now abandoned.

FIELD OF INVENTION

The present invention relates to a novel sintered high vanadium high speed steel characterized by an excellent combination of high hardness and ductility, and to a powder metallurgical method of making same,

BACKGROUND OF THE INVENTION

High speed steel is unsurpassed by other tool steels for its hot hardness. It is a preferred material for a variety of cutting and forming operations. Applications are as bits, end mills, drills, cutters, reamers, dies, shearing blades, and others. Another widely used tool material is Co-cemented tungsten carbide. High speed steel is superior to cemented carbide in ductility even when fully hardened, but is inferior in hardness. Such a high speed steel is called for that has properties intermediate between those of conventional high speed steel and of cemented carbide.

High speed steel comprises a matrix of martensite with a fine dispersion of $M_6C$, $M_{23}C_6$, MC type carbides (M denotes a metal(s) or an alloy(s)), wherein the ductility is prescribed primarily by the properties of the matrix and the hardness by the carbide contents. It has W, Mo, Cr, V, Co, C and bal Fe as main constituents with a nominal composition of W+2Mo (W-equivalent) 10–24% (by weight), Cr 4%, V 1–5%, Co 0–17%, Mn+Si less than 2%, and the remainder C and Fe (C is usually computed from C=0.19+0.017W-equivalent+0.2–0.22V(%)), wherein W and Mo are main $M_6C$ carbide formers, Cr is a main $M_{23}C_6$carbide former, and V a main MC carbide former (believed to exist as VC or $V_4C_3$ in steel), the total carbide content falling in the range of 20 to 30%.

Futile attempts have been made repeatedly to increase the carbide content. Increasing $M_6C$ carbide by increasing W-equivalent beyond the range stated above (and also carbon) on one hand is accompanied by a rapid fall of ductility with deterioration of microstructure. Increasing MC carbide by increasing vanadium (and also carbon) on the other hand in hindered by the difficulty of melting, that is, concurrent rise in the melting temperature and widening of the solid-liquid range. In addition, billets with increased carbide, in particular, with vanadium in excess of 5%, are susceptible to fracture when hot forged for fractioning coarse carbide nets formed along grain boundaries upon solidification.

In a recently proposed and commercially established atomizing technique, a molten alloy jet is cooled, at rates fast enough to suppress the formation of coarse carbide, into droplets which are then compacted in a capsule either by hot forging or by hot isostatic pressing to obtain solid billets. This process has the advantage of dispensing with the above forging step, but is still subject to limitations resulting from atomizing a vanadium-rich melt and deforming the billets into small sizes, thus the permissible vanadium content in no way exceeds 6.5%.

The present invention is based on the recognition that, while vanadium carbide once incorporated in the matrix acts as an ideal strengthener, little influenced by the existence of other carbides and the composition of the matrix, its incorporation is hindered in the conventional methods because they all start with a molten alloy melt. A method that relies solely on solid state reactions will now be disclosed, which enables as much vanadium as desired to be incorporated and thus provides a vanadium-rich high speed steel with increased hardness and least decreased ductility.

DISCLOSURE OF THE INVENTION

The purpose of the invention is to provide a hard yet ductile sintered high vanadium high speed steel of composition C 1.4–6.2%, W+2Mo (W-equivalent) 10.0–24.0%, Cr 3.0–6.0%, V 8.5–38%, Co less than 17%, the remainder Fe and inevitable impurities, with quality intermediate between that of conventional high speed steel and of cemented carbide.

Another purpose of the invention is to provide a method of producing the hard yet ductile sintered high vanadium high speed steel of composition C 1.4–6.2%, W+2Mo 10.0–24.0%, Cr 3.0–6.0%, V 8.5–38%, Co less than 17%, the remainder Fe and inevitable impurities, comprising the steps of mixing the alloy constituents in the form of pulverulent oxides with carbon or graphite (hereafter simply carbon) powder, heating the mixture in a stream of hydrogen, thereby reducing the mixture by the added carbon and the flowing hydrogen simultaneously to yield an alloy powder, pulverizing the alloy powder with necessary composition adjustments made, pressing the alloy powder to a compact, sintering the compact in a vacuum, subjecting or not subjecting the sintered body obtained to hot isostatic pressing, and finally converting the matrix of the sintered body into martensite by heat treatment.

Yet another purpose of the invention is to provide a simple method of producing the hard yet ductile sintered high vanadium high speed steel of composition C 1.4–6.2%, W+2Mo 10.0–24.0%, Cr 3.0–6.0%, V 8.5–38%, Co less than 17%, the remainder Fe and inevitable impurities, wherein control of vanadium carbide grain sizes in steel is enabled, comprising the steps of commingling the alloy constituents in the form of pulverulent oxides and carbon powder, thereby taking the vanadium oxide content at low levels, heating the mixture in a stream of hydrogen, thereby reducing the mixture by the added carbon and the flowing hydrogen simultaneously to yield an alloy powder, enriching the reduced alloy powder with vanadium carbide powder to a desired level, pulverizing the resulting mixture with necessary carbon corrections made, pressing the mixture to a compact, sintering the compact in a vaccum, subjecting or not subjecting the sintered body obtained to hot isostatic pressing, and finally converting the matrix of the sintered body into martensite by heat treatment.

The sintered high speed steel according to the invention is characterized by extraordinarily large amounts of fine MC type carbide uniformly present in the matrix, and by increased hardness and least decreased ductility.

The permissible ranges for the several alloy constituents are well established for conventional high speed steels. They are inherited by the present invention except that the high speed steel of the invention differs in composition from conventional high speed steel in respect of increased vanadium and associated carbon contents. Increase in vanadium content does not affect the established ranges for the other alloy constituents. This is because vanadium is the strongest carbide former in steel, and its carbide behaves in the matrix as if it were an independent constituent, little influenced by the existence of other elements. While vanadium may be added in arbitrary amounts, it is desirable that its content be held below 38%. Machining is easy up to 20% addition and still possible at 25% addition. Grinding becomes difficult at 38% addition beyond which there develops a tendency to embrittlement and loss of ductility. As for the lower limit, the substantial advantages from the addition of vanadium begin to appear when about 8.5% thereof has been added, as will be shown later in Example 3.

The high speed steel of the invention is produced by a powder metallurgical technique to which the preparation of a sinterable alloy powder is essential. The alloy powder is produced by firstly mixing the alloy constituents in the form of pulverulent oxides with carbon powder, then pulverizing the mixture to less than 10 microns, preferably less than 5 microns, and finally reducing it in a stream of hydrogen. It is pointed out in this connection that reduction of the oxide mixture by means of carbon or hydrogen alone commences at so high a temperature where a liquid phase intervenes that the reduced particles are susceptible to grain growth and agglomeration to such an extent as to render the subsequent pulverization impractical. The invention is based on the discovery that, in the presence of both carbon and hydrogen, the reduction can be effected at such a lowered temperature that the occurence of the grain growth is practically avoided. The invention is also based on another discovery that alloying may be achieved simultaneously with the reduction.

Carbon is added to the oxide mixture in an excess for dissolution and carbide formation with the surplus equalling one half of the theoretical for reducing the oxides to carbon monoxide, hydrogen taking the place of the other half. It is to be understood that this is a measure to be modified in accordance with specific reducing conditions with due account taken of the rate of hydrogen supply, heating rate and time, dimensions of the furnace to be used, etc. Three hours heating at about 1000° C. usually suffices for the reduction. The reduced alloy powder should preferably contain less than 1% of residual oxygen. Removal of the residual oxygen and/or increase of dissolved carbon, if desired, may be effected in the course of subsequent sintering by a further addition of carbon based on a composition analysis on the reduced powder. While removal of surplus dissolved carbon may in principle be effected in a similar manner by placing additional oxides to the reduced powder, this is usually accompanied by the difficulty of control and deterioration of sintered qualities. Rather the reducing conditions should be adjusted until the reduced powder falls slightly on the carbon deficit side of near complete reduction.

The reduced powder is once more pulverized, with necessary carbon adjustments made, to less than 10 microns, preferably less than 5 microns, added with a suitable binder, say paraffin, compacted, and sintered. Dewaxing may be executed independently of or at an early stage of sintering. Heating is effected in a vacuum or in a mon-oxidizing atmosphere of less than 0.1 mmHg, to ease extraction of gases (mostly carbon monoxide) from the compact, particularly at between 900° and 1100° C. In choosing a sintering temperature in the solid phase region, consideration is given to prolonged heating at low temperatures and accelerated grain growth at high temperatures. Depending on the alloy composition, the sintering temperature is usually taken in the range of 1050 (high vanadium contents) to 1250° C. (low vanadium contents), and the sintering time from one hour to two. As-sintered densities should desirably exceed 95% theoretical. One may cease sintering at about 95% density and thereafter employ hot isostatic pressing to obtain a full density especially when high ductilities are called for, or enhance sintering temperatures to obtain 98 to 99% densities when high hardnesses are chosen before high ductilities.

Heat treatment is carried out in a conventional manner, that is, austenization at about 1200° C., cooling in air, interrupted or not interrupted by austempering at around 500° C. to protect large-sized sintered bodies from thermal strains, and two to three times tempering at between 500° and 600° C. to transform the residual austenite into martensite and promote carbide precipitation in the matrix.

Another procedure which may be employed in obtaining a vanadium-rich alloy powder is to formulate the oxide mixture at low vanadium levels, and thereafter enrich the reduced product with pulverulent vanadium carbide. The substantial advantage of this two-step vanadium carbide enrichment consists in, besides the ease of reducing the oxide mixture, the capability of controlling the MC grain size with respect to that of the matrix, that is, fine MC grains to fine matrix grains or releatively coarse MC grains to fine matrix grains, a feature not possible with the previously described procedure. Situations exist in which coarse carbide grains are favored over fine carbide grains, and vice versa. To quote an example, the former exhibits greater abrasion resistance than the latter, at high sliding speeds in dryness.

BEST MODES FOR CARRYING OUT THE INVENTION

Figure 1:
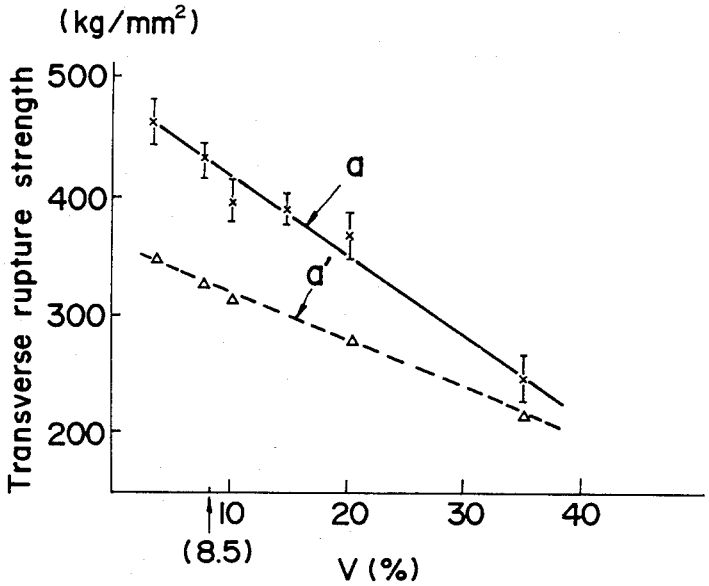
FIG. 1 is a graphic illustration of the transverse rupture strengths.

A better understanding of the invention will be obtained from the following Examples.

EXAMPLE 1

In producing an alloy powder of composition equivalent to that of JIS SKH 57 (10% W-3.5% Mo-4% Cr-3.5% V-10% Co-1.25% C-bal Fe) but with increased V and C contents (20 and 4.88% respectively), 1.261 kg of $WO_3$, 0.525 kg of $MoO_3$, 0.585 kg of $Cr_2O_3$, 2.942 kg of $V_2O_3$, 1.271 kg of CoO, and 6.808 kg of $Fe_2O_3$ (this Fe contained 0.4% of Si and as much Mn), all in sizes of 5 to 10 microns, were intimately mixed with 2.428 kg of carbon black, finely pulverized down to below 5 microns in a ball mill, pelletized without binder, and heated up slowly in a stream of hydrogen to 1050° C. and held there for three hours. The reducing conditions chosen were, charge: 10 kg, dimensions of the furnace (box type): 128 liters, hydrogen supply rate: 0.23 liter/-min, and heating rate: 4° C./min. Of the 2.428 kg of carbon added, 1.94 kg constitutes half of the theoretical 3.88 kg required for reducing the metal oxides to CO, and the remaining 0.488 kg for dissolution. The alloy powder obtained was of apparent density of 1.0 gr/cm$^3$, with 1.2% of residual oxygen and 3.80% of dissolved carbon. The pelletized alloy powder rendered itself with ease to pulverization down to below the original sizes, thereby a carbon correction havng been made by adding 1.08% of carbon of which 0.9% was for removing the residual oxygen and 1.80% for further dissolution.

Test pieces of 6 mm thick-10 mm wide-30 mm long were compacted from the adjusted alloy powder mixed with 4% of paraffin, and sintered under 0.05 Torr. Sintering at 1180° C. for 90 min was preceded by degassing at 900° to 1100° C. following dewaxing at 300° C. A sintered body of 96% density was obtained, which was further subjected to hot isostatic pressing at 1000 atm in argon for 40 min at 1150° C., to a density of 100%, followed by heat treatment of austenization for three minutes at 1110° C., cooling in air, three times tempering for two hours at 560° C.

Figure 2:
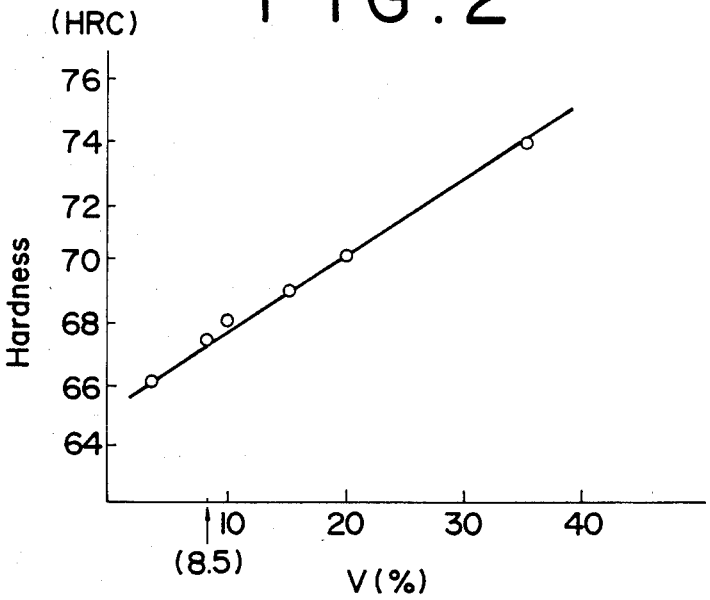
FIG. 2 of the hardnesses, of vanadium-rich alloys, in which the vanadium content was varied in the base composition of SKH57 in accordance with the procedure of the invention.
Figure 3:
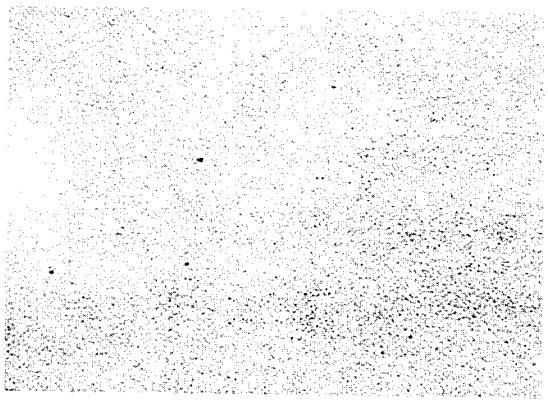
FIG. 3 is a micrograph of a hot isostatically pressed 20% V alloy in the as-quenched condition.

In order to ascertain the degree to which the mechanical properties are affected by the vanadium content and by the application of hot isostatic pressing, specimens containing 3 to 40% vanadium were made up in a manner similar to the one described above, and tested to determine transverse rupture strength (FIG. 1) and hardness (FIG. 2). The symbols "a" and "a'" in FIG. 1 refer to specimens with and without hot isostatic pressing respectively, this distinction disappearing in FIG. 2. While increase in hardness is accompanied by slow decrease in ductility, as high a transverse rupture strength of 210 to 230 kg/cm$^2$ as with conventional high speed steel is still retained in a 35% V alloy of the invention without hot isostatic pressing. The beneficial effect of hot isostatic pressing on ductility is obvious, especially so in the low vanadium region. The transverse rupture strengths of specimens without hot isostatic pressing but with increased sintering temperatures fall midways between "a" and "a'" of FIG. 1 indicating a possibility of dispensing with the hot isostatic pressing step in cases where high transverse rupture strength is not exacting. Hardnesses exceeding that of CIS V4 Co-cemented carbide which is 66 HRC are achieved with addition of 10% V or more. Alloys containing 10 to 15% V were found to develop a tendency to fracture when hot hammered at between 900° and 1100° C. Thus further densification of these high alloys is possible only by the application of hot isostatic pressing. FIG. 3 is a micrograph (magnification 400) of a hot isostatically pressed 20°V alloy of the invention in the as-quenched state, showing a uniform dispersion of fine VC carbide particles.

EXAMPLE 2

A different procedure was employed in making a 20% V alloy of Example 1. The same amounts of the metal oxides as in Example 1, but with $V_2O_3$ excluded, were intimately mixed with 1.6 kg of carbon block, and after being pulverized to less than 5 microns, reduced under the same conditions as in Example 1. Analyses revealed a residual oxygen content of 1.1% and a dissolved carbon content of 0.2%, in the reduced powder. The powder was further added with 0.06 kg of carbon and 2.470 kg of vanadium carbide in powder form (7 microns), and subjected to further mixing and pulverizing down to below 5 microns. The subsequent procedures such as compaction, sintering, hot isostatic pressing, and heat treatment were taken identically as those of Example 1. No differences in hardness, transverse rupture strength, and microstructure, were detected between the specimens prepared from the powder of Example 1 and from that of the present Example.

When a reduced alloy powder is intended to be used for the present procedure, the dissolved carbon thereof should desirably be held as low as possible, for a total of this carbon and that coming from added vanadium carbide may exceed a desired level, depending on the carbon and vanadium levels of the adder and the addend. If this carbon excess is anticipated, it is recommended to utilize a non-stoichiometic VC of low carbon content or to have the residual oxygen in the alloy powder consume the surplus carbon during the subsequent sintering stages.

EXAMPLE 3

Tool bits of 10 mm square section were prepared from the 3.5, 7.5 and 8.5% V alloys of Example 1, and compared for turning a SUS 27 rod of 50 mm diameter, using a speed of 390 rpm, feed of 0.25 mm/rev, and 2.5 mm depth of cut. A cutting fluid was used. The bit form was such that the back rake angle as 10°, side rake angle 15°, back relief angle 6°, back cutting edge angle 5°, side cutting edge angle 5°, and corner radius 2 mm. Cutter life was compared on the basis of the axial distance turned prescribed by flank wear. The 3.5 and the 7.5% V alloy bit covered only 12 mm, whereas the 8.5% V alloy bit had not yet reached the limit of permissible wear when interrupted for inspection at 38 mm. In another life comparison, alternations were made to the back rake angle (0°), side cutting edge angle (10°), and corner radius (1 mm). The 3.5 and the 7.5% V alloy bit failed at 35 mm this time, whereas the 8.5% V alloy bit still sustained at 75 mm the ability to yield good finish. These results remained unchanged whether the bits tested were subjected to hot isostatic pressing or not. It follows from what has been described that the desirable effect of vanadium enrichment manifests itself upon addition of 8% or more.

While ASP 60 TM, a commercial atomized high speed steel, contains only 6.5% of vanadium, it was found superior to the 7.5 and comparable to the 8.5% V alloy bit of the invention, contrary to the expectation that the higher the vanadium content, the higher the cutting performance. The alloys compared differ, however, both in composition and in way of making. That resistance to abrasion increases with increasing vanadium content was confirmed by additional tests on 10 and 15% V alloy bits of the same base composition.

EXAMPLE 4

Two-blade end mills of 10 mm diameter were prepared from the 3.5 and the 15% V alloy of Example 1, and compared for side milling a SKD 11 tool steel block of HRC 23 at a speed of 580 rpm, feed of 51 mm/min, and 9 mm depth of cut without a cutting fluid. Life was compared on the basis of the distance milled till tools reached 0.08 mm flank wear. The 3.5% V alloy end mill reached life at 800 mm, whereas the 15% V alloy end mill showed only 0.03 mm flank wear at 1600 mm, thus outperforming the 3.5% V alloy end mill by more than 500%.

INDUSTRIAL APPLICABILITY

As has been described in Examples 1 to 4, in the alloy design of dispersion-strengthened type high speed steels, one cannot speak of composition alone without referring to the contents and morphologies of dispersoids (MC type carbide in the present invention), that is, to the method of production by which the characteristics and performance of an alloy are greatly influenced. For example, the 3.5% V alloy of Example 1 is similar in composition to SKH 57, but has by far a higher transverse rupture strength than the latter produced by a melting process.

While tungsten carbide tools are widely and successfully used for most metal-cutting and -forming operations, high speed steel is usually more practical for cutting cast iron, aluminium, titanium, and their alloys, particularly in interrupted cutting. Ductilities of TRS 210 to 230 kg/mm$^2$ more than suffice for cutting purposes, but the use of high speed steel has been subject to restrictions resulting from its low hardnesses. It has been impossible to improve hardness or resistance to abrasion by increasing carbide content without lessening ductility. Methods are now provided by which to increase vanadium up to 38% and thus achieve a combination of high hardness and least decreased ductility in high speed steel.

The powder metallurgical aspects of the invention also present a considerable advantage over the conventional high speed steel in the production of cutting tools. For example, disposable inserts and the like have been made by machining stock materials. Increase in carbide, however, causes difficulty in fabrication, and the cost of machining and labor offsets the advantage of increased tool performance. Powder metallurgical techniques reduce these problems of fabrication to those of powder compaction which are practically free from any limitation.

We claim:

1. A sintered high vanadium high speed steel consisting essentially of C 1.4–6.2, W+2Mo 10.0–24.0, Cr 3.0–6.0, V 8.5–38, Co less than 17, all in weight%, the remainder Fe and inevitable impurities, characterized by a process of manufacture comprising the steps of preparing a powder mixture consisting of the oxides of the steel-forming metals and carbon, the amount of the carbon nearly equalling a sum of that for dissolution and carbide formation and half of that for reducing said metal oxides to carbon monoxide, pulverizing said mixture intimately down to below 10 microns, heating said finely pulverized mixture in a stream of hydrogen at a temperature between 900° and 1100° C. and for a sufficient time, whereby said mixture is reduced to an alloyed powder, pulverizing said alloyed powder again down to below 10 microns, with necessary carbon and/or composition adjustments made, preparing a compact from said pulverized alloyed powder, solid phase sintering said compact in a vacuum to a density of 95% or higher, and subjecting said sintered compact to a heat treatment, whereby a martensitic matrix is produced.

2. The steel of claim 1 wherein said sintered compact is isostatically hot pressed.

3. The steel of claim 1 wherein said composition adjustments are addition of vanadium carbide.

* * * * *